US005168933A

United States Patent [19]

Pritchard, Jr. et al.

[11] Patent Number: 5,168,933

[45] Date of Patent: Dec. 8, 1992

[54] COMBINATION HYDRAULIC TUBING HANGER AND CHEMICAL INJECTION SUB

[75] Inventors: John J. Pritchard, Jr., Harvey; Paul L. Dodd, Ponchatoula, both of La.

[73] Assignee: Shell Offshore Inc., Houston, Tex.

[21] Appl. No.: 770,849

[22] Filed: Oct. 4, 1991

[51] Int. Cl.[5] ..... E21B 34/14; E21B 37/06; E21B 41/02; E21B 43/01

[52] U.S. Cl. ..... 166/348; 166/87; 166/212; 166/310; 166/382

[58] Field of Search ..... 166/348, 382, 86, 87, 166/88, 312, 304, 319, 310, 373, 120, 133, 212, 386

[56] References Cited

U.S. PATENT DOCUMENTS

| | | | |
|---|---|---|---|
| 4,270,606 | 6/1981 | McStravick et al. | 166/133 X |
| 4,306,624 | 12/1981 | Bernard et al. | 166/336 |
| 4,388,970 | 6/1983 | Setterberg, Jr. | 166/133 X |
| 4,637,469 | 1/1987 | Spriggs et al. | 166/212 X |
| 4,708,202 | 11/1987 | Sukup et al. | 166/133 X |

*Primary Examiner*—Stephen J. Novosad

[57] ABSTRACT

A mudline tubing hanger is disclosed in which the tubing hanger is provided as an integral part of the tubing string and is set within the casing by an hydraulic setting mechanism driven through an external control line and actuated by a wireline shifted sleeve. Further manipulation of the sleeve isolates the setting mechanism from the tubing and external control line, establishing a chemical injection conduit with access to the tubing bore through the external control line.

7 Claims, 2 Drawing Sheets

13
17
10
14
16
11
15
17a
51
50
48
46
49
52
18
19
43
42
44
45
41
40
27
26
29
28
21
20
34
31
30
35
23
32
33
22
41
24
36
40
37
25
38
39
13
12

17
13
16
14
10
15
11
17a
51
48
50
18
46
49
47
19
52
43
44
45
40
41
26
27
20
29
28
21
34
31
30
35
23
32
33
22
25
24
36
37
39
38
13
12

COMBINATION HYDRAULIC TUBING HANGER AND CHEMICAL INJECTION SUB

BACKGROUND OF THE INVENTION

Several deepwater oil and gas fields have been recently discovered which necessitate new methods and apparatus in order to produce them. The depth of the water at these locations may range from 2000 to 7000 feet of water. Two of the proposed methods for developing such oil and gas fields are known as ocean floor completions and the production facilities on tension leg platforms. In ocean floor completions, a well would be drilled from a floating vessel on the surface of the ocean subsequently be completed by hanging strings of casing and production tubing from a wellhead that is positioned on the ocean floor or at the mudline. In the second method, a tension leg platform floats in an anchored position on the surface of the water while conducting well drilling operations and subsequently production operations. In the later case, the wellheads are positioned on one of the decks of the tension leg platform and a production riser extends from each of the wellheads down to the ocean floor and downwardly into the formation to the hydrocarbon producing zone. In both cases, it is often desirable to remove some of the weight of the tubing pipe string from the wellhead by providing it with a tubing hanger which may be set deep in the well.

A second problem exists in the production of hydrocarbons, especially in gas wells, in that hydrates are often formed in the tubing string under the right combination of pressure and/or temperature. These hydrates tend to restrict the flow of hydrocarbons in the tubing string or block it altogether. Thus, it is desirable to add a chemical into the tubing string at a depth in the well which is below that at which hydrates form in the tubing string. Any of several chemicals which prevent the formation of hydrates and are well known to the art may be injected into the tubing string.

SUMMARY OF THE INVENTION

It is an object of the present invention to develop an hydraulically actuatable tubing hanger which would be included as an integral part of the tubing string and lowered into the well thereby. The apparatus would act as a mudline tubing hanger which would support the weight of the tubing pipe string below the hanger after it had been set in the well by means of an externally connected control line. After the apparatus had been set in a well casing, the externally connected control line used to pressure up the tubing hanger latches would then be converted to a chemical injection device by a wireline tool. The tubing hanger of the present invention would be used when there is no shoulder in the casing on which it could be seated.

Another object of the present invention is to provide a tubing hanger that can be set in a well without manipulation of the tubing string and serves to reduce the load on a wellhead.

In accordance with the present invention the tubing hanger is connected into a tubing string between two sections thereof and lowered into a well together with a small quarter-inch tubing which would be strapped to the tubing string above the hanger in a manner well known to the art and extend to the surface where it could be connected to a source of hydraulic pressure fluid used to actuate the latching dogs of the hanger. If hydrates formed in the production fluid coming from the well, a determination would be made by means of calculations, experiments, or tests to determine the location or depth in the tubing string that hydrate formation would occur. The tubing hanger of the present invention would be connected into the tubing string at a point so that when the hanger and tubing string were run into the well, the hanger and chemical injection sub of the present invention would be positioned below the zone of hydrate formation in the well. After setting the hanger at the selected depth, the hanger would be pressurized to anchor it to the inner wall of the surrounding casing string and subsequently a wireline tool would be lowered through the tubing string to move a sleeve valve in the tubing hanger so that a corrosion inhibitor or a hydrate inhibiting chemical could be injected from the surface down the pressure tubing and into the bore of the tubing string.

DESCRIPTION OF THE PREFERRED EMBODIMENT

Figure 1:
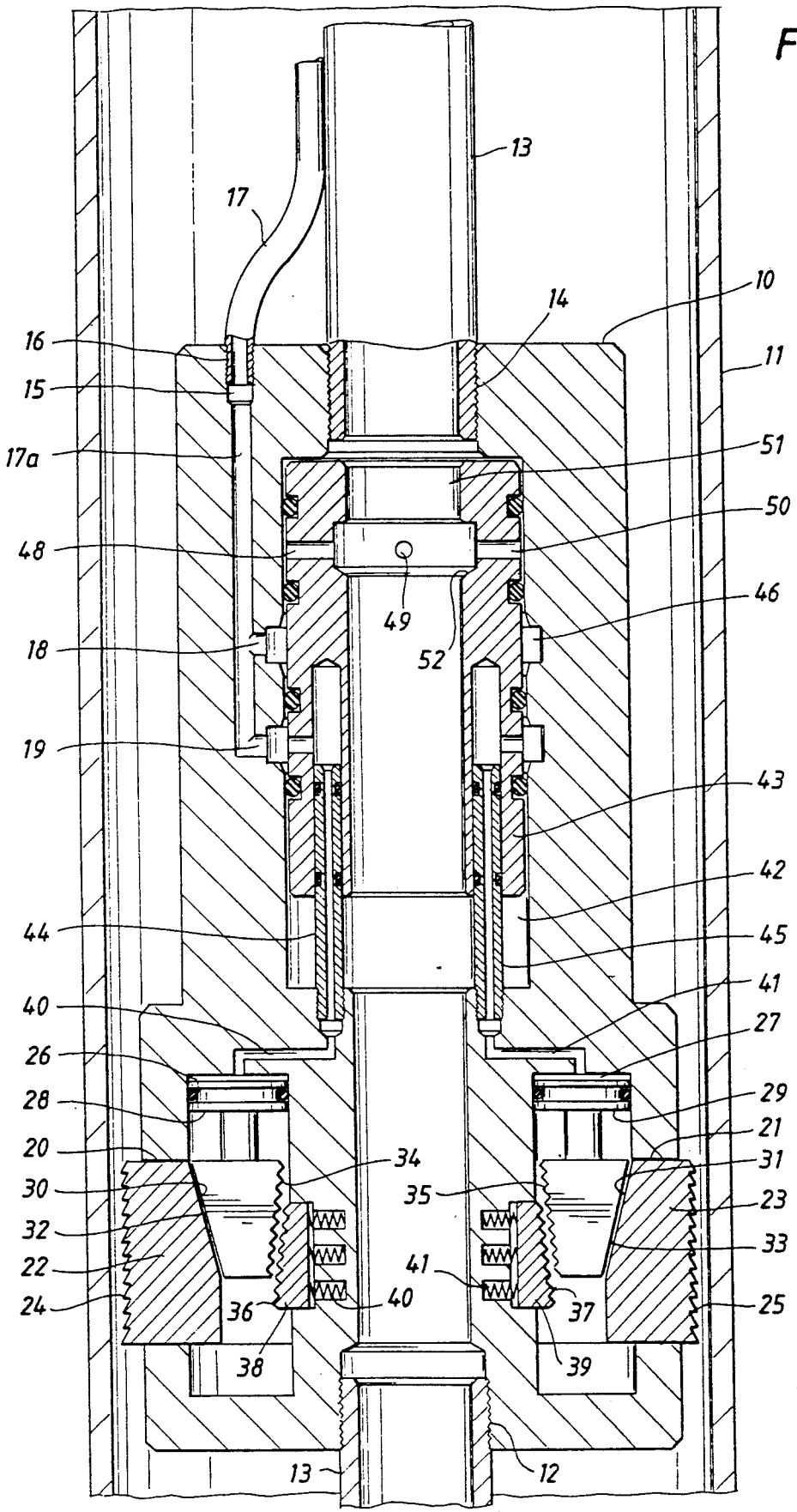
FIG. 1 is a cross sectional view of the tubing hanger of the present invention connected into a tubing string and positioned within a well casing before it has been actuated and latched to the casing.

Referring to FIG. 1 of the drawing, a hanger body member 10 is shown as being positioned within a well casing 11. The casing 11 may be the production casing in the well and may be of any suitable size, say for example, $7\frac{5}{8}''$ or $9\frac{5}{8}''$ in diameter. The hanger body 10 is provided at the lower end with suitable connector means such as screw threads 12 for connecting the body 10 to a section of production tubing 13. The production tubing may have a diameter of, say, $2\frac{7}{8}''$ or $3\frac{1}{2}''$. In a like manner, the upper end of the body member 10 is provided with screw threads 14 for connecting into the lower end of the tubing string 13.

The upper end of the hanger body 10 is also provided with an inlet port 15 having a screw-threaded connection 16 for securing the lower end of a small diameter pressure tubing 17. The pressure tubing 17 is bent over against the outer wall of the tubing string 13 and is secured thereto in any suitable manner well known to the art, as by straps (not shown). The inlet port 15 forms one end of a manifold **17*a* formed within the hanger body 10 which is provided with spaced-apart outlet ports 18 and 19**.

Formed within the lower part of the body member 10 are a plurality of vertically-extending and radially-directed slots 20 and 21 in which a pair of latching dogs 22 and 23 are slidably mounted for extension therefrom to contact the inner surface of the well casing 11. The faces of the latching dogs 22 and 23 are preferably serrated as at 24 and 25. The serrations may take the form of a plurality of horizontal teeth on the outer surface of the latching dogs 22 and 23. Preferably, the serrations are downwardly and outwardly sloping teeth so that in the event of failure of the apparatus, the hanger body could be pulled upwardly out of the well casing 11.

Formed within the lower portion of the hanger body 10 are a pair of piston chambers 26 and 27 in which pistons 28 and 29 are slidably mounted. The lower parts of the pistons 28 and 29 are preferably wedge-shaped in form and are provided with camming surfaces 30 and 31 which cooperate with camming surfaces 32 and 33 on the inner side of the latching dogs 22 and 23.

The other side of each of the pistons 28 and 29 near the lower ends thereof are provided with serrated faces 34 and 35. These serrated faces 34 and 35 are arranged to engage the outwardly-extending serrated faces 36 and 37 of cooperating wedge-shaped locking latches 38 and 39 which are slidably mounted in radially-extending slots in the hanger body 10. The locking latches 38 and 39 are arranged to be energized for outward movement in any suitable manner, as by the use of springs 40 and 41. Thus, when a pressure fluid is applied through conduits 40 and 41 to the piston chambers 26 and 27, the pistons 28 and 29 will be forced downwardly. At this time the camming faces 30 and 31 on the pistons engage the cooperating camming faces 32 and 33 of the latching dogs 22 and 23 to drive the dogs 22 and 23 outwardly until they engage the inner wall of the well casing 11. At that time the serrated faces 34 and 35 on the inner wall of the piston will be forced down across the serrated faces 36 and 37 of the locking latches 38 and 39 forcing them inwardly. With the locking latches and 38 and 39 positioned in this manner, the pistons 28 and 29 are locked against any movement upwardly which would tend to release the latching dogs 22 and 23 from the casing wall. Once the latching dogs 22 and 23 are in engagement with the inner wall of the casing 11, the tubing string 13 at the surface is allowed to move downwardly so that the weight of the string forces the teeth of the latching dogs 22 and 23 further into the well casing 11. The body member 10 of the hanger is provided with a central chamber 42 in which a sleeve valve is slidably mounted for limited vertical movement. Mounted in the bottom of the central chamber 42 and extending up into the sleeve valve 43 are a pair of tubes 44 and 45 which are in communication at their lower ends with the fluid passageways 40 and 41 and are in communication at the upper end with the outlet port 19. It is to be understood that flow passageways 46 and 47 are circular in form and extend around the sleeve valve 43.

Figure 2:
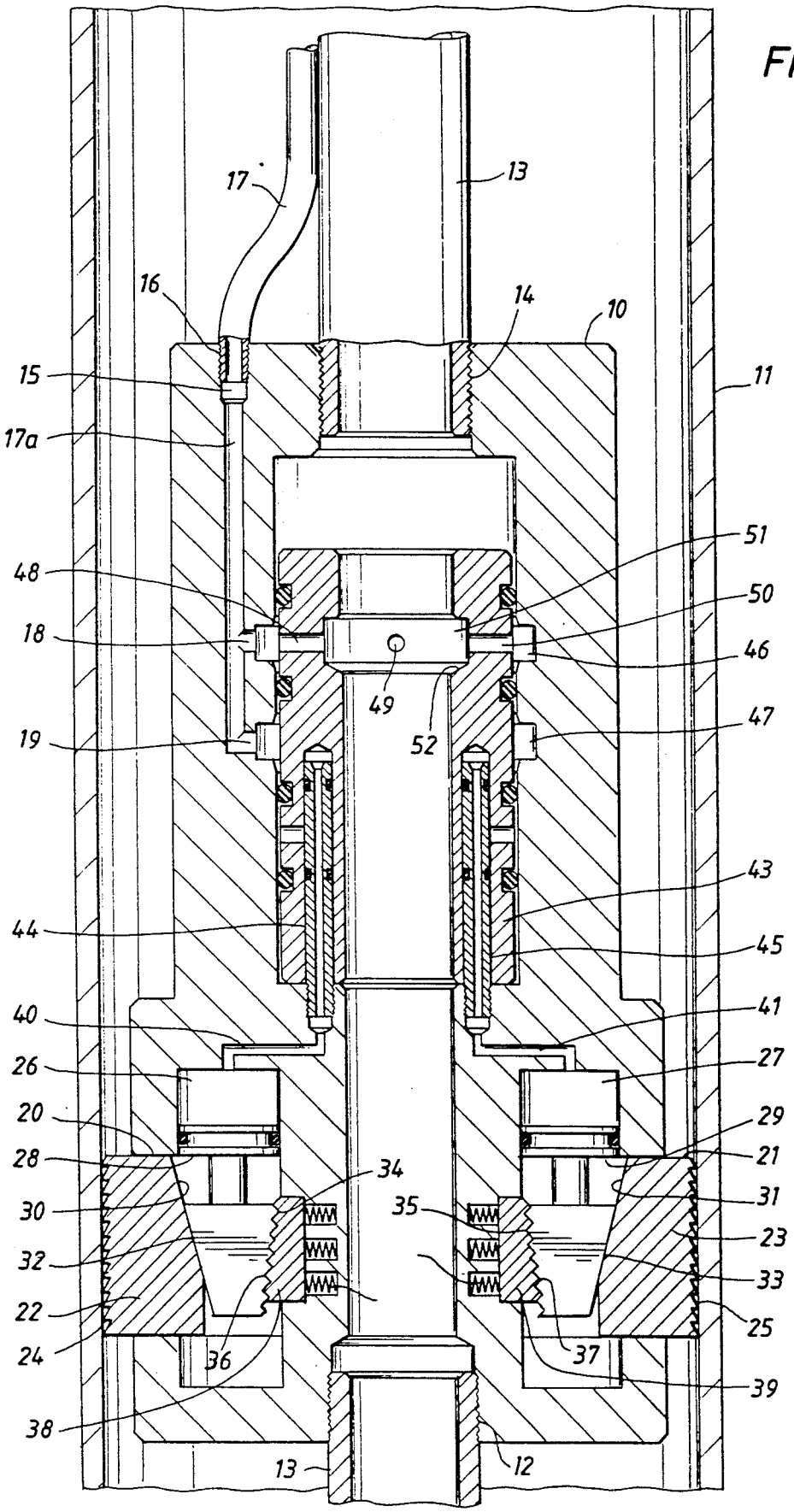
FIG. 2 is a cross sectional view of the tubing hanger after the dogs have been latched to the inner wall of the casing and after the central sleeve valve has been shifted so that a chemical fluid can be injected into the bore of the tubing.

The sleeve valve 43 is also provided with a series of fluid passageways 48, 49 and 50 which are subsequently moved down with the sleeve valve to cooperate with the outlet port 18 of the manifold, as shown in FIG. 2. The upper end of the sleeve 43 is also provided with a latching groove 51 and/or a shoulder 52. After the hanger body 10 has been set by hydraulic pressure applied through the tubing 17, a wireline running tool of any suitable design well known to the art is lowered through the tubing string to engage the recess 51 or shoulder 52 to force the sliding sleeve valve 43 from its position shown in FIG. 1 to its position shown in FIG. 2. In the position shown in FIG. 2 the outlet port 19 is blocked off by the sleeve valve body so there is no further communication between the pressure tubing 17 and the piston chambers 26 and 27. At the same time the fluid ports 48, 49 and 50 in the upper part of the sleeve valve 43 are brought into communication with the outlet port 18 of the manifold. In orginally setting the hanger, water or glycol or any other fluid may be pumped down through tubing 17 to actuate the pistons of the hanger and set the dogs against the casing. After changing the sliding sleeve valve 43 to the position shown in FIG. 2 a corrosion inhibitor or a hydrate inhibitor fluid may be pumped from the surface down through tubing 17, out the outlet 18 and through the fluid passageways 48, 49 and 50 to be discharged in the bore of the tubing 13.

As previously pointed out, in order to effectively prevent the formation of hydrates in a well tubing, it will be necessary to introduce a hydrate inhibiting fluid in a well below that point or depth at which the hydrates form. Thus, in using the apparatus of the present invention to provide .for a method of preventing the formation of hydrates in a well, a determination would be made after studying the well as to what depth in the well the hydrates formed. If the hydrates were found to form in a particular well at a depth of 3500 feet, a tubing string for that well would be made up by screwing together sections of tubing in a manner well known to the art. At a point in the tubing which would be below the hydrate-forming point, say, 3600 feet, the apparatus of the present invention would be connected into the tubing string and the entire tubing string with its hanger would be run into the well. With the hanger on the tubing string positioned at 3600 feet below the surface, a pressure fluid such as ethylene glycol, would be pumped down through tubing 17 and into the tubing hanger and piston chambers 26 and 27 to set the dogs 22 and 23 against .the casing 11. With the tubing anchored in place, the valve 43 would be moved downwardly to the position shown in FIG. 2 by use of a wireline 2, well known to the art. After withdrawing the wireline 2 from the tubing string, a hydrate preventing chemical in fluid form would be pumped down the tubing 17 and discharged into the bore of the tubing to return to the surface with the production fluid from the well.

It may be seen that in utilizing the present invention in this manner the weight of all of the tubing string below the tubing hanger would not have to be supported from a wellhead, say, one that is buoyantly supported by a tensin leg platform. Since in a 20,000 foot well, the tubing may weigh about 250,000 pounds, it may be seen that most of this weight would be removed from the floating platform and supported by the tubing hanger of the present invention.

In one example of a deepwater well completion, a 20,000-foot well may have a bottom hole pressure of 13,500 psi and a pressure of 10,000 psi at the mudline. The bottom hole temperature is 250 degrees F. while the temperature at the mudline can be as low as 40 degrees F. Hydrates are known to form in production fluids from 40 degrees F. to as high as 70 degrees F. Thus, in this case, a 3½" diameter tubing string equipped with the mudline hanger of the present invention would have the hanger set at between 4000 and 5000 feet. After setting the tubing hanger the injection of various chemicals would take place. Such chemicals may be methanol, glycol, certain paraffin solvents such as toluene and diesel, amine based corrosion inhibitors, calcium bromide, zinc bromide, calcicum chloride, seawater and nitrogen.

What is claimed is:

1. An hydraulically actuatable tubing string hanger adapted to be connected into a well production tubing string and run into a well together with an external small-diameter tubing for selectively actuating and setting the hanger by hydraulic pressure and subsequently allowing chemical fluid to be injected into the bore of the production tubing string, said apparatus comprising:

a hanger body having a central bore therethrough with connector means at the ends of said bore for connecting the hanger body into a production tubing string;

latching dogs carried by said hanger body and mounted to move radially outwardly from said hanger body at spaced-apart locations around the circumference thereof;

pressure-operated actuating means carried in said hanger body adjacent said latching dogs for engaging said latching dogs and forcing them outwardly to engage the inner wall of a surrounding well casing when positioned therein;

fluid manifold means carried by said hanger body having an inlet port adjacent the top thereof for selectively receiving an operating fluid under pressure and a chemical inhibitor fluid from a small-diameter tubing;

a first outlet port from said fluid manifold means in fluid communication with said pressure-operated actuating means associated with said latching dogs;

a second outlet port from said fluid manifold means in communication with the bore of the body member; and an axially-slidable sleeve valve carried within the bore of said body member for limited sliding movement for selectively closing one of said outlet ports of said fluid manifold means.

2. The apparatus of claim 1 wherein a pressure-operated actuating means for said latching dogs includes a piston chamber formed in said hanger body;

a piston movable in said piston chamber;

an operating element carried by one side of the piston and adapted to be moved into engagement with the adjacent surface of a latching dog;

the other side of said piston adapted to be in selective communication with a source of pressure fluid to actuate said piston.

3. The apparatus of claim 2 wherein the operating element carried by one side of the piston is a wedge-shaped element having a sloping face next to the inner surface of the adjacent latching dog which has a mating sloping surface.

4. The apparatus of claim 3 including an energized locking latch carried in said hanger body and engageable with said piston to lock the piston in place when the latching dog is in its extended position.

5. The apparatus of claim 1 wherein the outer faces of the latching dogs which are adapted to engage a surrounding well casing wall have a friction surface form of downwardly and outwardly pointed teeth of a hardness to cut into the inner surface of a well casing.

6. The apparatus of claim 4 wherein the contacting surfaces of the energized locking latch and the adjacent piston surface are serrated in a like manner to prevent movement of the piston once the locking latch has engaged the piston.

7. A method of preventing the formation of hydrates in a deepwater hydrocarbon producing well having a well casing which comprises the steps of:

determining the depth in the well at which hydrates would form in a production tubing string;

making up a tubing string for said well by connecting together end to end a plurality of sections of tubing to make up a tubing string of a selected length;

installing a selectively-operable valved tubing hanger and chemical injector device, said device being installed in said tubing string at a selected location spaced in a manner such that the device, when installed in the cased well, will be below the determined depth of hydrate formation;

connecting an hydraulic power line to the hanger of a length to extend to the top of the well;

lowering the tubing string and hydraulic power line and tubing hanger into the well to the selected depth;

applying pressure through the hydraulic power line to anchor the hanger to the well casing;

selectively adjusting the valved device to operate in its chemical injection mode; and pumping a hydrate-preventing chemical down the hydraulic power line, through the device and into the tubing string at a depth below which hydrates form in the well.

* * * * *